US005917512A

United States Patent [19]

Weber et al.

[11] Patent Number: 5,917,512

[45] Date of Patent: Jun. 29, 1999

[54] CLEANING CONTAINER AND METHOD FOR CLEANING A PRINTHEAD OF AN INK JET PRINTER

[75] Inventors: Roland Weber, Fürth; Stefan Engel, Nuremberg, both of Germany

[73] Assignee: J. S. Staedler GmbH & Co., Nuremberg, Germany

[21] Appl. No.: 08/654,947

[22] Filed: May 29, 1996

[30] Foreign Application Priority Data

May 29, 1995 [DE] Germany ..... 195 18 989

[51] Int. Cl.[6] ..... B41J 2/165

[52] U.S. Cl. ..... 347/28

[58] Field of Search ..... 347/21, 28, 85, 347/87, 100

[56] References Cited

U.S. PATENT DOCUMENTS

| | | | |
|---|---|---|---|
| 5,500,659 | 3/1996 | Curran, Jr. et al. | 347/28 |
| 5,509,140 | 4/1996 | Koitabashi et al. | 347/86 |
| 5,589,861 | 12/1996 | Shibata | 347/28 |
| 5,589,865 | 12/1996 | Beeson | 347/28 |

FOREIGN PATENT DOCUMENTS

| | | | |
|---|---|---|---|
| 0 471 274 B1 | 2/1992 | European Pat. Off. . | |
| 27 04 704 A1 | 8/1978 | Germany . | |
| 3805 840 A1 | 8/1989 | Germany . | |
| 39 32 462 A1 | 4/1991 | Germany . | |
| 57-31576 | 2/1982 | Japan | 347/28 |
| 4-115954 | 4/1992 | Japan | 347/28 |

*Primary Examiner*—N. Le
*Assistant Examiner*—Thien Tran
*Attorney, Agent, or Firm*—Kenyon & Kenyon

[57] ABSTRACT

A method for cleaning the printhead of an ink jet printer includes the steps of separating an ink container from the printhead, connecting a cleaning container containing cleaning fluid to the printhead, and drawing cleaning fluid through the printhead, thereby cleaning the printhead. A device for cleaning the printhead includes a cleaning container connector element and a cleaning container that are shaped substantially the same as an ink container connecting element and an ink container, respectively.

11 Claims, 2 Drawing Sheets

| Table -- Exemplary Cleaning Agent Compositions (By Weight) | |
|---|---|
| First Exemplary Embodiment | 5 - 40% ethylene glycol<br>≤ 2% surfactant<br>≤ 1% disinfectant<br>60 - 90% distilled water<br>≤ 5% ingredients from the group consisting of triethanolamine and a pigment |
| Second Exemplary Embodiment | 5 - 40% ethylene glycol<br>60 -90% distilled water<br>.05 - 8% ingredients from the group consisting of triethanolamine, a surfactant, a disinfectant, and a pigment |
| Third Exemplary Embodiment | 20% ethylene glycol<br>1% surfactant<br>0.2% disinfectant<br>78.8% distilled water |

FIG. 6

CLEANING CONTAINER AND METHOD FOR CLEANING A PRINTHEAD OF AN INK JET PRINTER

FIELD OF THE INVENTION

The invention relates to a method and a device for cleaning the heads and nozzles of ink jet printers, where ink jet printers are understood to mean all, generally electronically controlled, automatic writing, drawing and printing systems or machines which use so-called ink jet systems, preferably "drop on demand" systems, for the production of text or graphics, and whose ink storage unit is removably arranged and connected with the print head, directly or via an ink feed system, with aqueous inks, India inks or pastes being used as the writing or drawing agent.

Inks used for this purpose consist predominantly, for example, of ethylene glycol, pigment and water, or of other water-miscible solvents with a high boiling point, and water.

BACKGROUND INFORMATION

From the state of the art, various solutions for cleaning the heads and nozzles of the ink jet printers are known. For example, DE-OS 37 32 797 (A1) shows a device for cleaning the nozzle of an ink jet printer, which has a supply tank with cleaning fluid in a replaceable container. Furthermore, a collecting tank for used cleaning fluid is also to be housed in the container. This device is therefore necessarily relatively complicated and voluminous. It is therefore generally not suited for use in color printers, for example, which are equipped with several ink storage units and related nozzles. Furthermore, an additional pump connection and a feed-back system for the excess cleaning fluid are absolutely necessary for this.

SUMMARY OF THE PRESENT INVENTION

In contrast, it is the task of the invention to create a method and a device for cleaning the heads and nozzles of ink jet printers, which makes it possible to achieve good and inexpensive cleaning of the heads and nozzles quickly and easily, with the appropriate equipment.

This task is accomplished using the characteristics of claims 1 and 5. Advantageous forms and further developments of the invention are covered in the other claims.

The method, according to the present invention, for cleaning the heads and nozzles of ink jet printers, i.e. of electronically controlled, automatic writing, drawing and printing systems or machines which use so-called ink jet systems, preferably "drop on demand" systems, for the production of text or graphics, and whose ink storage unit(s) is/are removably arranged and connected with the print head, directly or via an ink feed system, where one or several ink container(s) is/are assigned to at least one print head, particularly consists of separating the ink container(s) from the print head, instead connecting one or more cleaning containers, and then starting a special cleaning program or a printing program, with the cleaning fluid being pressed or drawn through the ink channels and through the nozzles, and the ink channels and nozzles, i.e. their openings being freed of encrustations, deposits or other contaminants.

Cleaning in this connection particularly takes place on the basis of mechanical, chemical and/or thermal action of the cleaning agent, i.e. the cleaning method on the contaminants.

With this method, it is advantageous if the cleaning container(s) is/are connected to the print head and/or the nozzle group in each instance, after removal of the ink container(s) and before the cleaning process, by means of releasable connector elements.

As an alternative, however, after the ink container(s) has/have been separated from the line or shut off, and before the cleaning process, the cleaning container(s) can also be connected with or switched into the print head or the nozzle group in each instance via the feed lines, by means of control valves or other switching systems.

The method is furthermore supplemented in that a blank or unusable piece of paper is inserted or drawn in and that the paper absorbs the used cleaning fluid and the dissolved contaminants during the cleaning process, if no separate collector container for used cleaning agent is provided.

Depending on the printer or the requirements, the method can be controlled in such a way that each nozzle group is cleaned individually, one after the other, or in such a way that all the existing nozzles or nozzle groups are cleaned at the same time, in one pass.

After completion of the cleaning process, the cleaning container(s) is/are removed from the print head or the nozzle groups, or the line is uncoupled. Instead, the ink container is then re-inserted or re-connected via the lines and control units.

A device according to the invention is explained in greater detail below, on the basis of several exemplary embodiments, using the drawings.

BRIEF DESCRIPTION OF THE DRAWINGS

FIG. 6 shows a table of exemplary cleaning agent compositions (by weight).

For clarification, the following items are used as reference numbers here:

1 printer/ink jet printer;
01 print head,
02 cover for the print head,
10, 11, 12, 13, 14 nozzle group(s),
101 nozzles/nozzle openings,
102 ink channels,
103 connector taps (to 10 ff.),
20, 21, 22, 23, 24 ink container(s),
200 connector element (to 20 ff.),
30, 31, 32, 33, 34 cleaning container(s),
300 connector element(s) (to 30 ff.),
40 cleaning fluid, 50 ink, 90 paper.

DETAILED DESCRIPTION OF THE INVENTION

Figure 1:
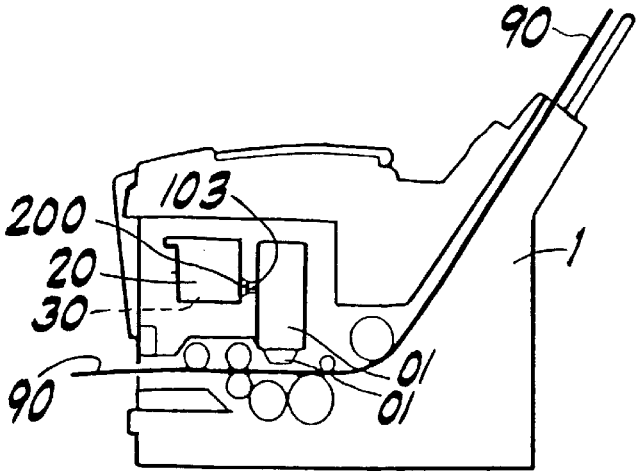
FIG. 1 shows an ink jet printer with a print head and an ink or cleaning container according to the present invention.

FIG. 1 shows, in simplified form, an ink jet printer 1 with a print head 01 and an ink container 20, or with a cleaning container 30 with which the latter can be replaced, which is arranged as part of a device for cleaning the heads 01 or nozzles of ink jet printers 1, i.e. of electronically controlled, automatic writing, drawing and printing systems or machines which use so-called ink jet systems, preferably "drop on demand" systems, for the production of text or graphics, and whose ink storage units are preferably removably arranged and connected with a print head 01 or with several print heads, directly or via an ink feed system.

During cleaning, the used cleaning fluid is absorbed and transported away by the paper 90, which passes through the printer 1 or stands in the nozzle region during the cleaning process, together with any dissolved contaminants.

The ink container 20, which is coupled to the connector tap 103 via the connector element 200 or 300 in each instance, or the replaced cleaning container 30, make it possible to print or clean alternately, depending on the contents of the container 20 or 30 being used.

Figure 2:
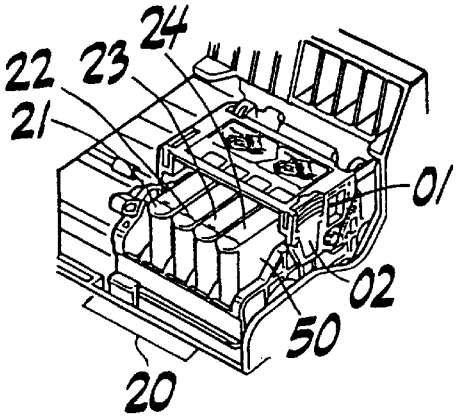
FIG. 2 shows a print head with four ink containers.
Figure 3:
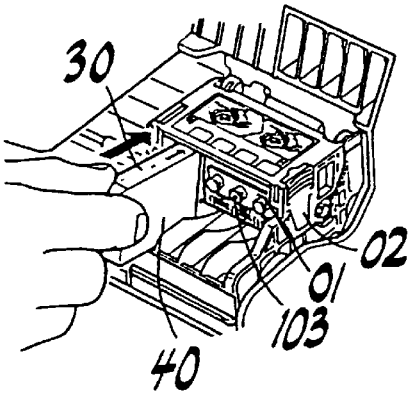
FIG. 3 shows the print head according to FIG. 2, with the cleaning container inserted.

In the print heads 01 shown in FIGS. 2 and 3, one or more ink container(s) 20—as a single container or as a container block—21, 22, 23, 24 are assigned to at least one print head 01, to implement the method described above.

According to the present invention, analogous to the ink container(s) 20, 21, 22, 23, 24, there is at least one cleaning container 30 which is present or can be connected by means of corresponding connector taps 103 or other couplings.

It is advantageous if the cleaning containers 30, 31, 32, 33, 34 correspond in design, size and arrangement to the ink containers 20, 21, 22, 23, 24 or corresponding container blocks.

In addition, each cleaning container 30, 31, 32, 33, 34 has at least one connector element 300, with which it can be removably and replaceably connected with the print head 01 or the nozzle group 10, 11, 12, 13, 14 in question. For this purpose, it is furthermore necessary that the connector elements 300 of the cleaning container(s) 30, 31, 32, 33, 34 correspond to the connector elements 200 of the ink container(s) 20, 21, 22, 23, 24, unless a hose or pipe connector piece or a suitable adapter is placed in between.

If the cleaning device is not supposed to be constantly coupled in and out by replacing the cleaning containers, it is advantageous if a control valve is arranged in the feed lines between the cleaning containers 30, 31, 32, 33, 34 and the print head 01 or each of the nozzle groups 10, 11, 12, 13, 14 in question, via which the cleaning fluid 40 is or can be switched in before the cleaning process.

Figure 4:
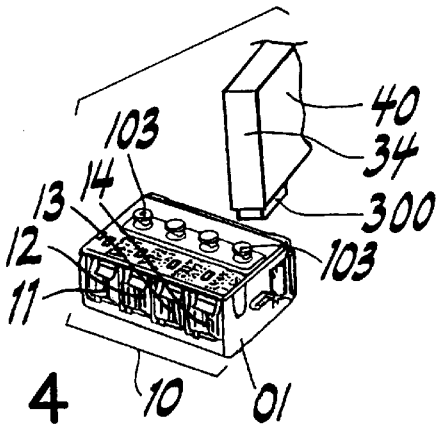
FIG. 4 shows a removed print head with a cleaning container that can be set onto it.
Figure 5:
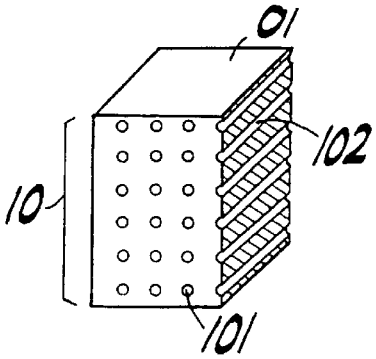
FIG. 5 shows a print head of which only portions are shown, on an enlarged scale.

FIGS. 4 and 5 show a print head 01 with its nozzle groups 11, 12, 13 and 14, which are brought together to form a uniform nozzle group 10, as shown in FIG. 4, while FIG. 5 shows a portion of a print head 01 on an enlarged scale, which has a single nozzle group 10, composed of a plurality of individual nozzles 101. Ink channels 102 lead to each of the nozzles 101; these open out directly into the connector tap 103 or lead to the channel lines of the system via reversing valves.

The cleaning container 34, filled with cleaning fluid 40, is just being placed onto the connector tap 103 of the nozzle group 14 with its connector element 300. It is particularly advantageous if the device contains a cleaning agent 40 which essentially corresponds to the basic mixture of the ink 50 usually used in the printer 1 in question, containing either no pigment or a very slight amount of a suitable pigment.

It is advantageous if the cleaning agent 40 consists, for example, essentially of 5 to 40% by weight ethylene glycol and 60 to 95% by weight distilled water, and contains up to 2% by weight surfactant, up to 1% by weight disinfectant as well as up to 5% by weight triethanolamine, pigments and/or other additives, such as complex formation agents, corrosion protection agents, pH regulators, etc. Another exemplary embodiment of a cleaning agent 40 may consist, for example, essentially of 5 to 40% by weight ethylene glycol, 60 to 90% by weight distilled water, and 0.05 to 8% by weight ingredients from the group consisting of triethanolamine, a surfactant, a disinfectant, and a pigment. A third exemplary embodiment of a cleaning agent 40 may consist, for example, essentially of 20 percent by weight ethylene glycol, 1 percent by weight surfactant, 0.2 percent by weight disinfectant, and 78.8 percent by weight distilled water. The exemplary embodiments of the cleaning agent 40 are listed in the Table or see FIG. 6 also.

TABLE

Exemplary Cleaning Agent Compositions (By Weight)

| | |
|---|---|
| First Exemplary Embodiment | 5–40% ethylene glycol<br>≦2% surfactant<br>≦1% disinfectant<br>60–90% distilled water<br>≦5% ingredients from the group consisting of triethanolamine and a pigment |
| Second Exemplary Embodiment | 5–40% ethylene glycol<br>60–90% distilled water<br>.05–8% ingredients from the group consisting of triethanolamine, a surfactant, a disinfectant, and a pigment |
| Third Exemplary Embodiment | 20% ethylene glycol<br>1% surfactant<br>0.2% disinfectant<br>78.8% distilled water |

In principle, the method and the device proposed can be used for all types of writing or drawing means. When using inks, India inks or other agents with organic solvents, such as alcohol or ketone, it is advantageous to coordinate the base of the cleaning agent with this solvent; this is also true when using other water-miscible solvents with a high boiling point and water as the ink base, e.g. glycerine, pyrrolidones such as N-methyl pyrrolidone, etc., although the cleaning agent explained in greater detail above is already also well suited for this purpose.

What is claimed is:

1. A method for cleaning a printhead of an ink jet printer, the ink jet printer having an ink container removably connected to the printhead via a connecting element, comprising the steps of:

separating the ink container from the printhead by separating the ink container from the connecting element;

connecting a cleaning container to the printhead by connecting the cleaning container to the connecting element, the cleaning container containing cleaning fluid; and drawing the cleaning fluid through the printhead using one of a cleaning program, a writing program, and a printing program.

2. The method according to claim 1, further comprising the steps of:

inserting a sheet of paper into the ink jet printer; and absorbing the cleaning fluid and dissolved contaminants using the sheet of paper.

3. The method according to claim 2, wherein the printhead includes a plurality of nozzles and wherein the step of drawing the cleaning fluid through the printhead includes drawing the cleaning fluid through each of the plurality of nozzles individually, one after another.

4. The method according to claim 2, wherein the printhead includes a plurality of nozzles and wherein the step of drawing the cleaning fluid through the printhead includes drawing the cleaning fluid through each of the plurality of nozzles at the same time.

5. The method according to claim 1, wherein the printhead includes a plurality of nozzles and wherein the step of drawing the cleaning fluid through the printhead includes drawing the cleaning fluid through each of the plurality of nozzles individually, one after another.

6. The method according to claim 1, wherein the printhead includes a plurality of nozzles and wherein the step of drawing the cleaning fluid through the printhead includes drawing the cleaning fluid through each of the plurality of nozzles at the same time.

7. A device for cleaning a printhead of an ink jet printer, the printhead releasably connected to an ink container through an ink container connecting element, comprising:

a cleaning container connecting element, the cleaning container connecting element having a shape substantially similar to a shape of the ink container connecting element, the cleaning container connecting element selectively connecting to the printhead and disconnecting from the printhead; and a cleaning container, the cleaning container having a shape substantially similar to a shape of the ink container, the cleaning container selectively connecting to the cleaning container connecting element and disconnecting from the cleaning container connecting element.

8. The device according to claim 7, further comprising a cleaning fluid contained in the cleaning container.

9. The device according to claim 8, wherein the cleaning fluid consists essentially of:

5 to 40 percent by weight ethylene glycol;

60 to 90 percent by weight distilled water; and 0.05 to 8 percent by weight ingredients from the group consisting of triethanolamine, a surfactant, a disinfectant, and a pigment.

10. The device according to claim 8, wherein the cleaning fluid consists essentially of:

5 to 40 percent by weight ethylene glycol;

up to 2 percent by weight surfactant;

up to 1 percent by weight disinfectant;

60 to 90 percent by weight distilled water; and up to 5 percent by weight ingredients from the group consisting of triethanolamine and a pigment.

11. The device according to claim 8, wherein the cleaning fluid consists essentially of:

20 percent by weight ethylene glycol;

1 percent by weight surfactant;

0.2 percent by weight disinfectant; and 78.8 percent by weight distilled water.

* * * * *

UNITED STATES PATENT AND TRADEMARK OFFICE

CERTIFICATE OF CORRECTION

PATENT NO. : 5,917,512
DATED : June 29, 1999
INVENTOR(S) : Weber et al.

It is certified that error appears in the above-identified patent and that said Letters Patent is hereby corrected as shown below:

Column 1, line 35, delete "PRESENT";

Column 1, line 37, after "task" insert - - an object - -;

Column 1, line 37, before "invention" insert - - present - -;

Column 2, line 26, before "invention" insert - - present- -;

Column 2, line 33, after "head" insert - - according to the present invention with - -;

Column 4, line 61, change "2" to - - 1- -; and

Column 4, line 66, change "2" to - - 1- -.

Signed and Sealed this

Tenth Day of April, 2001

*Attest:*

Nicholas P. Godici

NICHOLAS P. GODICI

*Attesting Officer*

*Acting Director of the United States Patent and Trademark Office*